US005161722A

United States Patent [19]

Hembree

[11] Patent Number: 5,161,722

[45] Date of Patent: Nov. 10, 1992

[54] ADJUSTABLE BACKPACK FRAME FOR COUNTERBALANCING PACK LOAD

[76] Inventor: Wayne A. Hembree, 16311 Oxford Ct., Bowie, Md. 20715

[21] Appl. No.: 688,290

[22] Filed: Apr. 22, 1991

[51] Int. Cl.[5] ..... A45F 3/08

[52] U.S. Cl. ..... 224/262; 224/211; 224/148

[58] Field of Search ..... 224/210, 211, 212, 213, 224/261, 262, 263, 148, 153

[56] References Cited

U.S. PATENT DOCUMENTS

| | | | |
|---|---|---|---|
| 178,545 | 6/1876 | Merriam . | |
| 204,066 | 5/1878 | Merriam . | |
| 362,302 | 5/1887 | Merriam . | |
| 1,040,413 | 10/1912 | Renard . | |
| 1,217,262 | 2/1917 | Abercrombie . | |
| 3,106,037 | 10/1963 | Harkey . | |
| 3,180,545 | 4/1965 | Southwick . | |
| 3,246,644 | 4/1966 | Peterson . | |
| 3,282,483 | 11/1966 | Babcock . | |
| 3,327,788 | 6/1967 | Kolpe . | |
| 3,897,894 | 8/1975 | Lawrence . | |
| 3,902,640 | 9/1975 | Geiben . | |
| 3,912,138 | 10/1975 | Pava . | |
| 4,037,763 | 7/1977 | Turchen | 224/211 |
| 4,087,031 | 5/1978 | Fenner . | |
| 4,179,053 | 12/1979 | Figura . | |
| 4,189,075 | 2/1980 | Hall . | |
| 4,214,685 | 7/1980 | Pletz | 224/211 |
| 4,217,998 | 8/1980 | Alexander . | |
| 4,248,367 | 2/1981 | Buel . | |
| 4,318,502 | 3/1982 | Lowe et al. . | |
| 4,489,866 | 12/1984 | Korte . | |
| 4,515,300 | 5/1985 | Cohen . | |
| 4,561,578 | 12/1985 | Bell . | |
| 5,060,833 | 10/1991 | Edison et al. | 224/148 |

FOREIGN PATENT DOCUMENTS

| | | | |
|---|---|---|---|
| 70456 | 5/1946 | Norway | 224/210 |

OTHER PUBLICATIONS

*Backpacker*, Feb. 1991, pp. 59–64, The External Frame Pack Test, Dave Getchell, only information available.

*Camping 1990*, Mail Order Catalog, pp. 9–13, REI, only information available.

*Primary Examiner*—Linda J. Sholl

*Attorney, Agent, or Firm*—Kerkam, Stowell, Kondracki & Clarke

[57] ABSTRACT

An improved backpack frame is provided with an upper section adapted to be selectively and adjustably pivoted about a lower section allowing the weight of the upper section to counterbalance the weight of the lower section so that the center of gravity of the pack load is substantially over the hip line of the bearer. Positioning of the weight load over the hip line provides the backpack frame bearer with a less tiring and more comfortable means of bearing heavy loads. The upper section pivots about an axis just above and parallel with the shoulders of the bearer and contains a clearance for the head to allow forward positioning. The amount of pivoting is controlled by the backpack frame bearer in accordance with the terrain and conditions being traversed, and a pivot hinge and slide mechanism allow easy underway adjustment. The lower backpack section is fitted to the body from the shoulders to the waist by a harness. An automatic water supply is optionally provided through the frame of the backpack, with means for controlling water flow while underway. In an alternate embodiment, automatic adjustment may be provided wherein the load is sensed by a sensor and the frame adjusted automatically by a motor responsive to the reading of the sensor.

19 Claims, 8 Drawing Sheets

ADJUSTABLE BACKPACK FRAME FOR COUNTERBALANCING PACK LOAD

FIELD OF THE INVENTION

This invention relates to a frame adapted to be fitted to the waist and/or the back of a bearer, who is generally travelling on foot, for the purpose of carrying loads, commonly called a backpack frame. The backpack frame of the subject invention provides bearer-controllable counterbalancing of the pack loads while underway and optionally provides automatic balance control. The backpack frame of the subject invention is particularly suitable for professional backpack frame bearers such as military personnel, geologists, guides and others who must sometimes travel long distances on foot in remote areas bearing heavy loads as part of their professional work activity, but is also suitable for other users, such as, for example, recreational campers, hikers and outdoor enthusiasts.

BACKGROUND OF THE INVENTION

Conventional backpack frames attempt to provide proper balance of the load by keeping the pack load as close to the body as possible, while attempting to provide air circulation between the bearer's back and the pack load. Such frames are constructed such that heavier loads may be placed high in the pack near the shoulders, helping to balance the pack load. It is also a goal of conventional backpack frames to provide easy access to the load.

The need to provide proper balance of the pack load is of constant concern to the backpack user, because maximum load-carrying capability and maximum range are largely affected by the degree of balance obtained. One known method to help achieve balance is to place the heaviest part of the load high in the pack above the shoulders. The frame bearer then leans forward slightly to try to bring the weight over the bearer's hips so that the center of gravity of the pack load is aligned with an imaginary vertical plane passing through the hips of the bearer, hereinafter referred to as the hip line. Unfortunately, prior art frames require the user to lean forward to carry the load in a bent position in order to dispose the pack load over the hips of the bearer. The incomplete balance afforded by conventional frames increases the bearer's work in carrying the load, and the exertion necessary to meet such increased work demands limit the bearer's maximum load-carrying capability and range below that which could be gained with perfect balance and upright posture.

Various mechanisms have been developed in the prior art in an attempt to improve the situation, as shown, for example, in the patent to Fenner, U.S. Pat. No. 4,087,031. Typical backpack frames are described in publications directed to camping and backpacking. For example, Backpacker. February 1991, pp. 59–64, includes a review and rating of commercially available backpacks. A somewhat similar collection of commercially available backpacks is provided in Camping Mail Order Catalog, 1990, pp. 9–13.

Known backpack improvements suffer from one or both of two serious shortcomings:

1) they do not allow positioning or counterbalancing of the center of gravity of the pack load over the bearer's hip line in the postures that the bearer must choose for the various terrains and conditions that the bearer encounters; and 2) in shifting the pack load by bending to bring the upper part of the load forward as a partial counterbalance, the lower part of the load is often moved further back from the body. Both of these disadvantages are substantially eliminated or at least minimized by the present invention.

Backpack frames are also known to provide water storage as a means of providing drinking water in remote areas. Such packs generally require the bearer to remove the backpack frame or the assistance of another to gain access to the water. The present invention provides a construction which allows the bearer to quench his thirst on the move without disrupting his effort.

SUMMARY OF THE INVENTION

A backpack frame is provided having an upper frame and a lower frame and the upper frame can be pivoted around the lower frame for positioning or counterbalancing of the pack load. The backpack frame is fitted from the shoulders to the waist by conventional strap means. The center portion of the forward part of the upper frame is free of obstruction to provide clearance for the head when the upper frame is pivoted forward. In a manually controlled embodiment of the invention, an arm is connected from a pivot connection on the upper frame through a pivoting slide mechanism disposed on the side of the lower frame to cause the upper frame to rotate about the pivot connection when the arm is moved at an angle. The arm extends downward and forward of the frame to allow the bearer to adjust the degree of rotation to the upper frame and, consequently, the point of counterbalance. The arm is reconfigurable from its extended position to a folded configuration along the side of the frame to move it out of the way for storage or when first mounting the frame to the bearer.

In an embodiment of the invention, achieving automatic implementation of the pivoting action of the upper frame, means are provided to automatically rotate the upper frame to provide a 37 best-balance" condition determined in relationship to a sensor.

In another embodiment of the invention, water storage is provided in the upper frame and a connection is provided between the water storage and a port adjacent the bearer's mouth as a means for the frame bearer to have access to drinking water stored in the balanced pack without having to remove the pack load or the water container.

In still another embodiment of the invention, the upper and lower frame members may be conveniently "knocked-down" or separated for ease of handling and transport. To this end, selected parts of the upper frame are pinned to the lower frame with hand removable capture joints that facilitate separation of the frame members.

BRIEF DESCRIPTION OF THE DRAWINGS

The above and other objects, features, and advantages of the present invention will become more fully apparent to those skilled in the art to which this invention pertains from the following detailed description, taken in conjunction with the annexed drawings, wherein like or corresponding reference characters refer to like or corresponding parts throughout the several Figures, and in which.

DETAILED DESCRIPTION OF THE INVENTION

Figure 1:
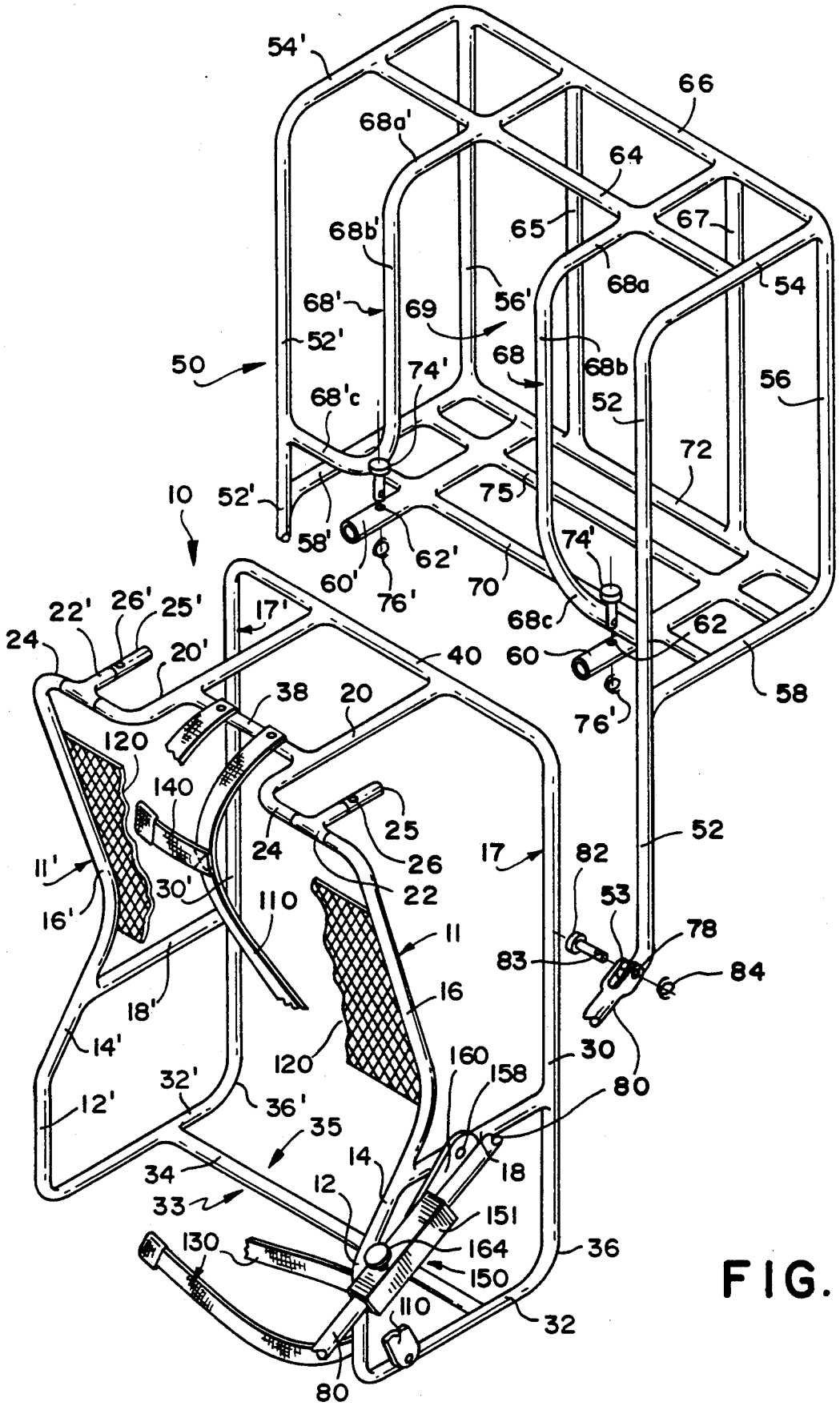
FIG. 1 is an exploded and partially fragmentary view of the adjustable counterbalanced backpack frame of the present invention showing the lower and upper backpack frame members in perspective and showing the rotatable upper frame in exploded view removed from the lower frame.

Referring to FIG. 1, the backpacking frame, hereinafter simply called the "frame", is shown as comprising two major parts, a first lower frame 10 and a second upper frame 50. The upper frame 50 forms a separate, rotatable upper frame member that is attached by hinge means 22, 22' to a lower portion of the lower frame 10 to allow placement of upper weight carried by the upper frame forward of the frame bearer's center of gravity.

In a more compact construction of the invention, as shown and described in connection with FIG. 8, a pivot connection for the upper frame is disposed at the upper portion of the lower frame and connected to a slide member disposed on the upper frame. A hand control lock is provided on the slide member to allow the upper frame to be selectively locked in position once adjusted to the desired position by the bearer. In both constructions of the invention, placement of a pack load or weight on the upper frame 50, 450 is used to counterbalance the load or weight carried on the lower frame 10, 410 by adjusting the rotation of the upper frame. Adjustment of the rotation of the upper frame can be accomplished underway, while the frame is attached to the frame bearer, to accommodate different loads, terrain and different postures of the frame bearer.

Referring again to FIG. 1, each of the upper and lower frame sections 10 and 50, respectively, are preferably made of light weight interconnecting frame members, such as light gauge tubular aluminum, which provide a sturdy frame construction and keeps the overall weight of the frame at a minimum. Lower frame 10 includes a pair of front contoured body support members 11, 11' comprising a straight short piece 12, 12' central curved members 14, 14' and upper members 16, 16'. As can be readily visualized, both the upper and lower frames are symmetrical about a vertical, imaginary center plane and thus can be said to have a left side and a right about the center side as viewed in the drawing. For convenience, left side part members which correspond to identical right side part members are designated with the same reference character but with an additional apostrophe "'" mark. For example, right central member 14 which has an inward bow so that it can snugly cradle the back of the bearer when the frame is in place on the bearer, has a corresponding left side member 14'. Also, that part of the frame which is adapted to be held against the bearer's body is designated the front or forward portion of the frame, while that part of the frame farthest from the bearer's body is designated the back or rearward portion of the frame. This nomenclature will be used throughout the description.

Body support members 11, 11' are joined intermediate their ends to an intermediate portion of a substantially open rectangular back frame section 17 by a pair of horizontal struts 18, 18'. Back frame section 17 is formed of vertical members 30, 30' which are connected at their lower ends to body support members 11, 11' through horizontal front to back cross pieces 32, 32'. Cross pieces 32, 32' are in turn rigidly connected to each other in spaced relationship by a left to right cross piece 34. The length of piece 34 is selected to approximate the width of a typical backpacker and is preferably substantially centrally disposed between opposite ends of cross pieces 32, 32'. This provides two important advantages. First, it enables the backpack to be positioned snugly about the hips of the bearer, because front open area 33 allows sides 12, 12' to be positioned along the sides of the bearer. This could not be accomplished if a strut extended across members 12, 12' at their lower, forwardmost position, i.e., at the corners where elements 12, 12' join elements 32, 32'. The second advantage is that back open area 35 is provided and cross piece 34 serves to support the weight of the load stored in the lower frame. Back open area 35 makes it easier to load elongated roll members into the lower frame. Although less advantageous, the bottom of the frame may be provided with more than one horizontal cross member joined to and extending between the side members and may further be provided with a canvas or web load support between such members to provide a floor support. Such an arrangement is more useful when the elements to be carried by the frame are substantially less than the width of the frame and thus relatively small in size. The upper ends of the vertical back members are joined to each other by horizontal cross piece 40 which frames in the substantially open rectangular back section 17 formed by members 34, 30, 30' and 40. The rectangular back frame section 17 is joined to the front body support members 11, 11' by a pair of horizontal front to back frame members 20, 20' extending between rear cross piece 40 and a pair of forward cross pieces 24, 24'. As shown in FIG. 1, cross pieces 24, 24' do not extend completely across member 11, 11' and thus provide an open area which when the frame is mounted to the bearer is positioned slightly below the neck of the bearer.

Mounted to each cross piece 24, 24' substantially midway between its ends are rotatable hinge means 22, 22' in the form of tubular T connectors to which the upper frame is supported and which allow rotation of the upper frame about supporting cross pieces 24, 24' of the lower frame 10. To this end, the rotatable members 22, 22' may include tubular extensions 25, 25' adapted to be pinned to forward extending socket members 60, 60' of upper frame 50. As will be recognized by those skilled in the art, the receiving socket may alternatively be formed by extensions 25, in which case members 60, 60' are slightly smaller in diameter than members 25, 25' so as to be received therein. To this end, members 25, 25' each include through openings 26, 26' adapted to be aligned with through openings 62, 62' in members 60, 60' so that the mating members can be pinned or joined together by conventional pins 74, 74' adapted to be held in place or restrained from withdrawal by ring members 76, 76' positioned in through openings disposed in the ends of pins 74, 74'. Upper frame 50 also includes downwardly extending forward arm members 52, 52' connected to a manually operated extension arm 80 which passes through a pivotable slide mechanism 150 at its lower end. The upper end of arm members 80 telescopically fits over the lower end of arm 52 which includes a through hole 53 adapted to be coaligned with holes 78 in arm 80. A pin 82 inserted through holes 53 and 78 locks the arm in place. Ring 84 inserted into opening 83 in the end of pin 82 after the pin is inserted through holes 53, 78 retains the pin in place to keep the parts from separating. Only a single arm operating mechanism is shown, but if desired the operating mechanism may be duplicated on the other side of the frame.

Figure 2:
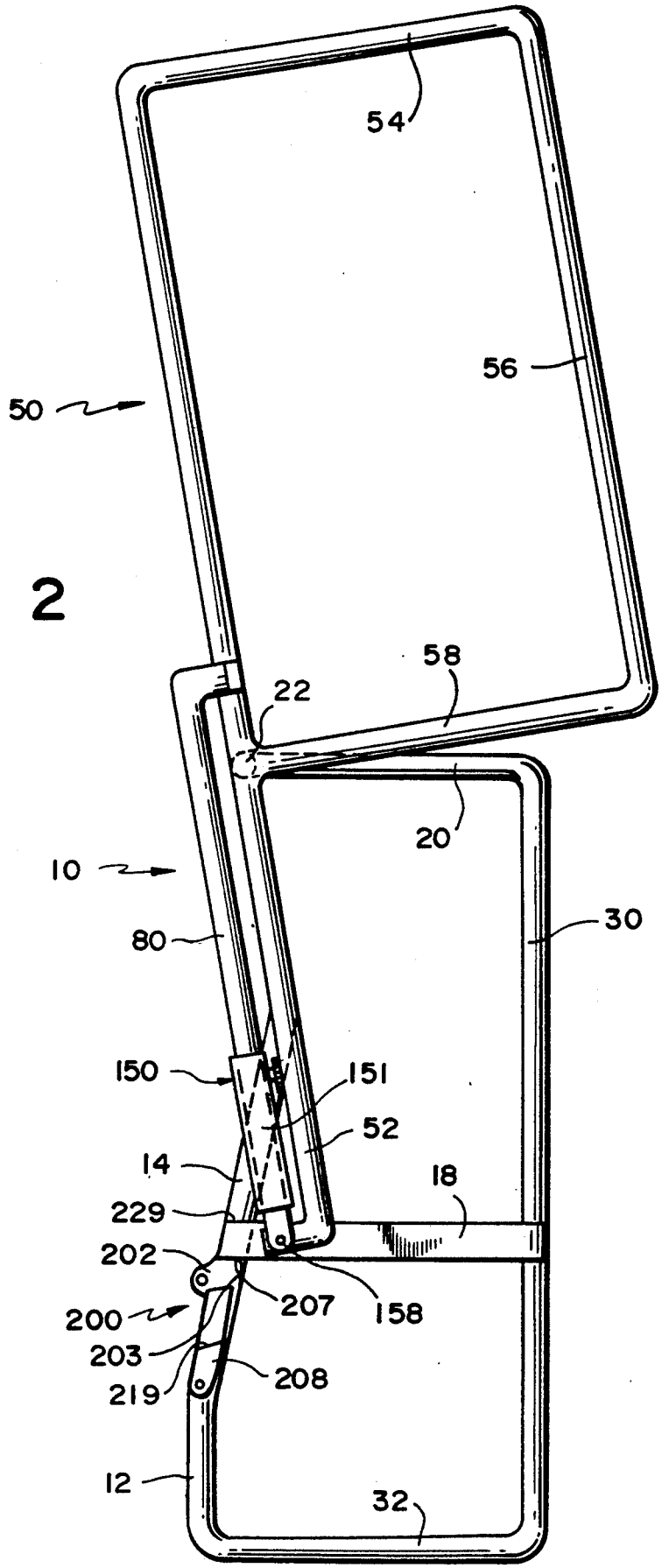
FIG. 2 is a right side view of the backpack frame according to the present invention showing a manual control mechanism, with the operating arm in its folded position.
Figure 3:
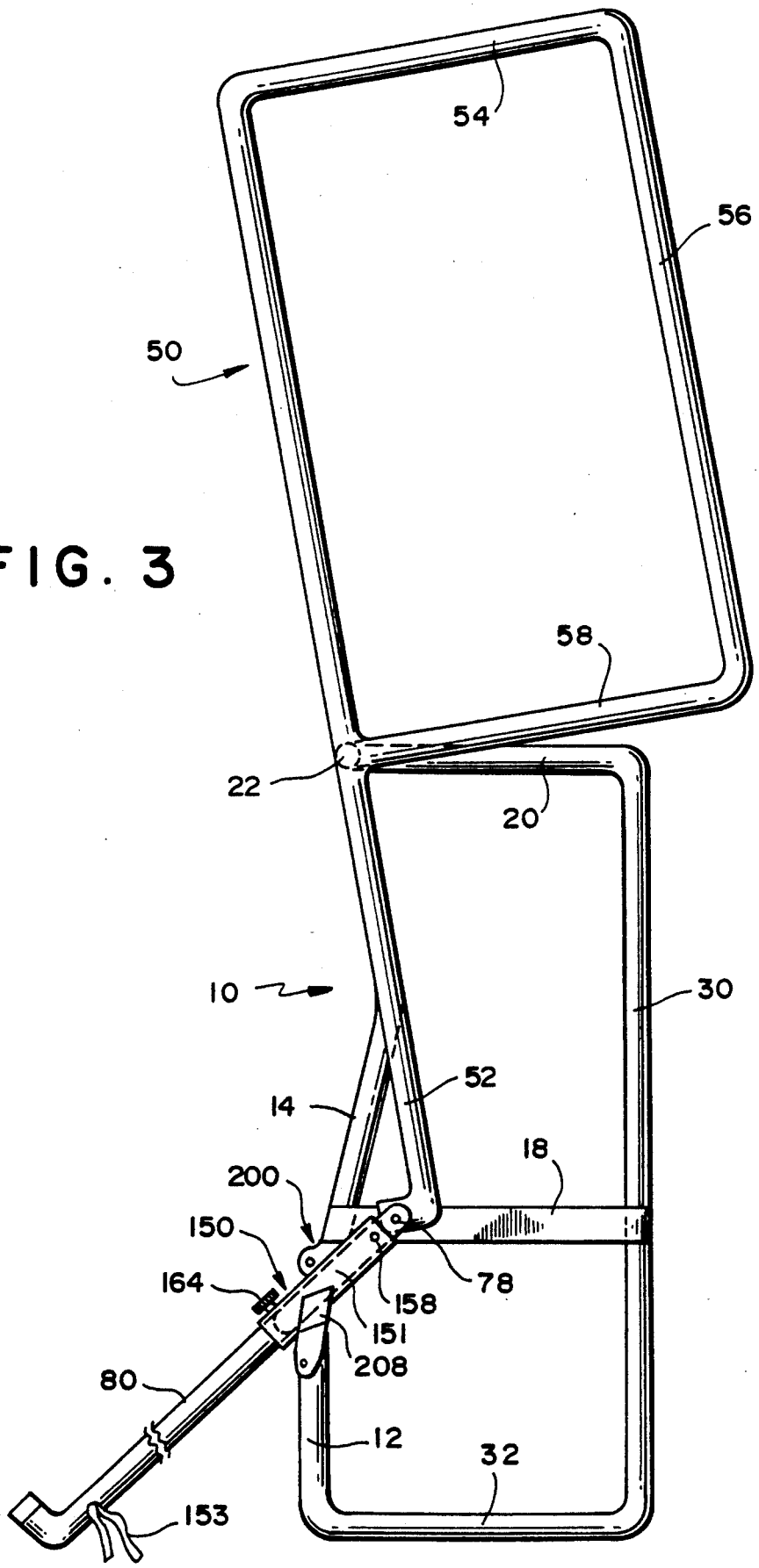
FIG. 3 is a right side view of the backpack frame according to the present invention, showing a manual control mechanism with the control arm extended.
Figure 4:
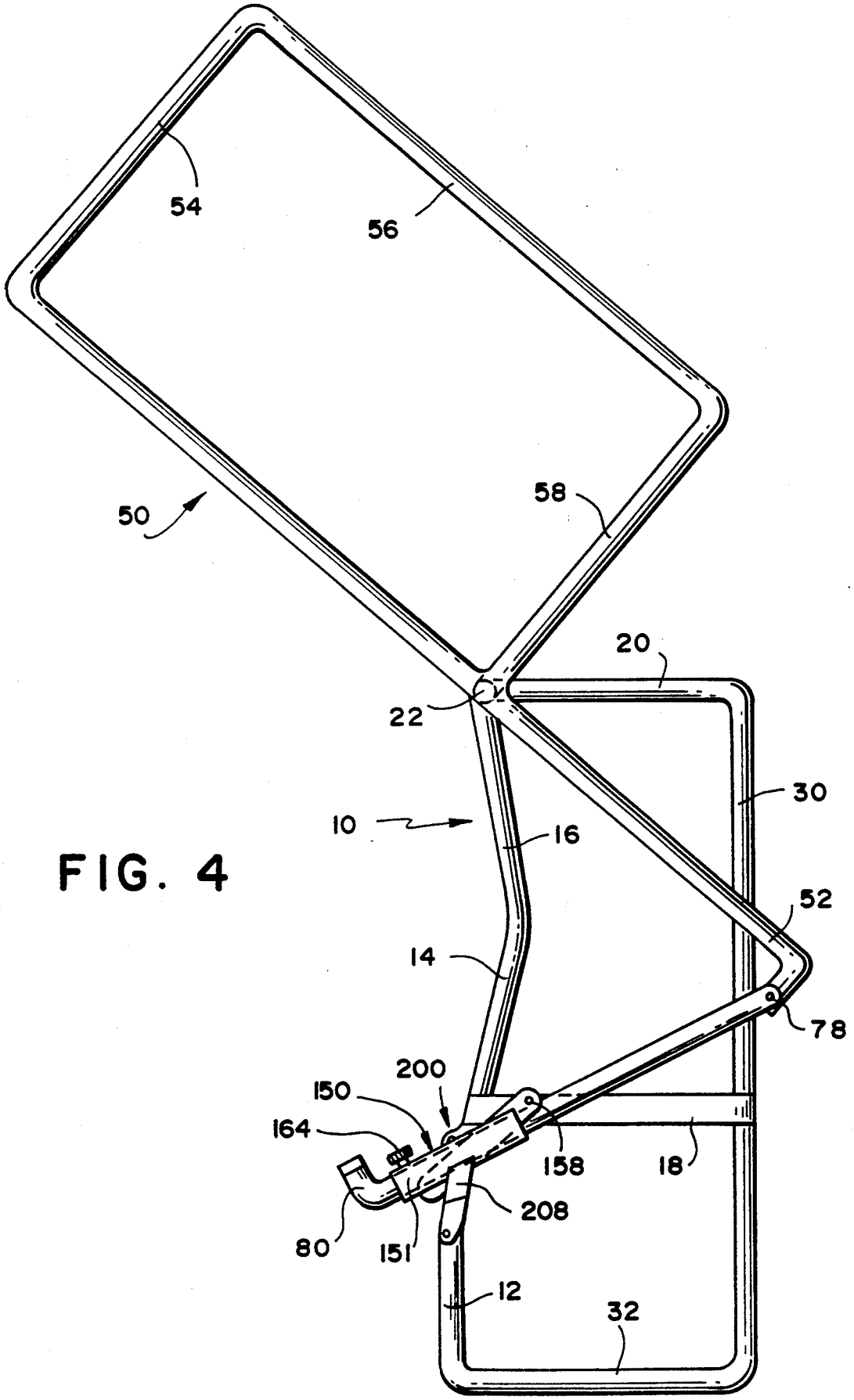
FIG. 4 is a right side view of the backpack frame according to the present invention showing the mechanism depicted in FIG. 3, reconfigured to pivot the upper frame forward, i.e., in a position over the bearer's body.
Figure 6:
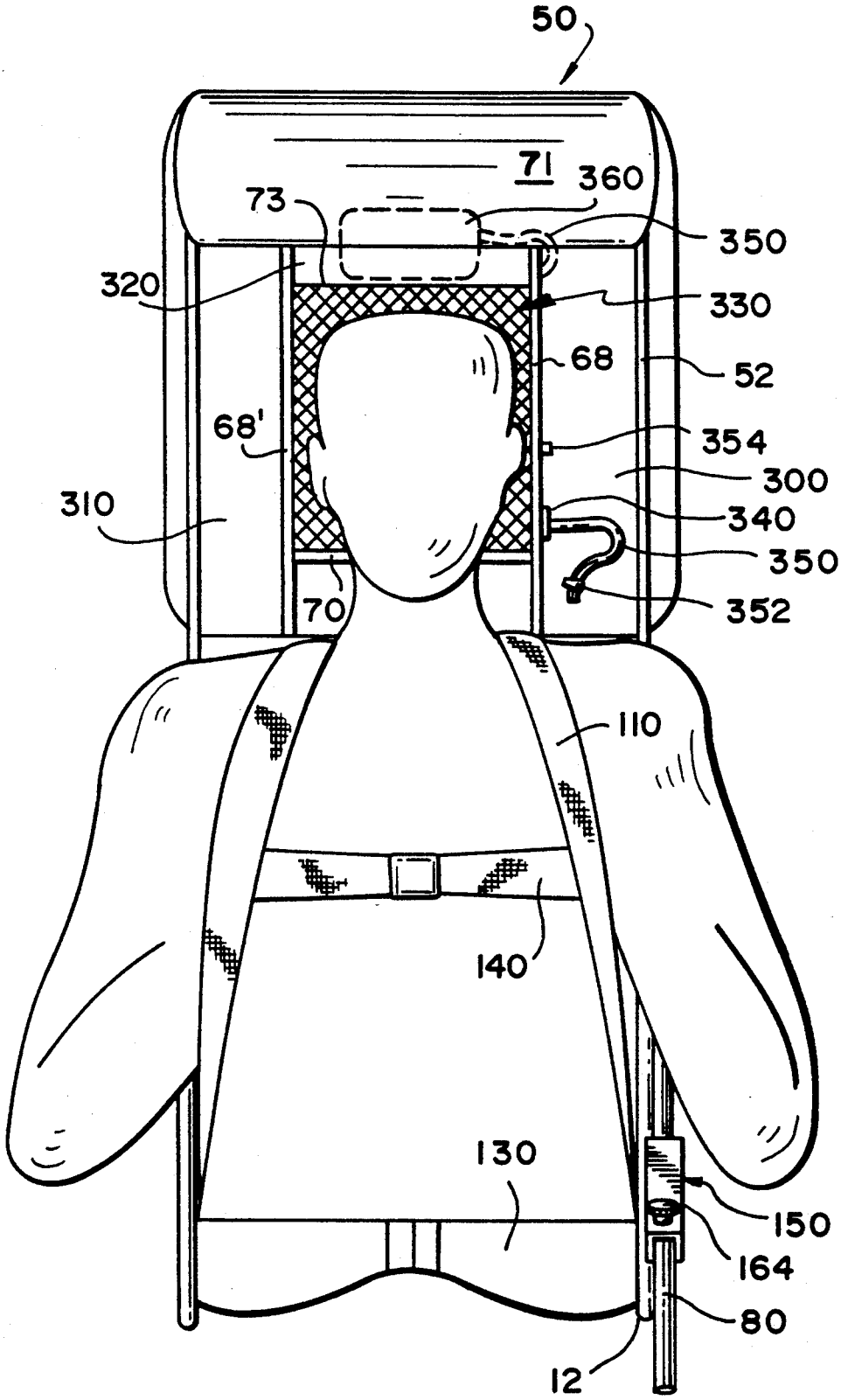
FIG. 6 is a front view of the adjustable counterbalanced backpack frame according to the present invention fitted to a bearer.
Figure 7:
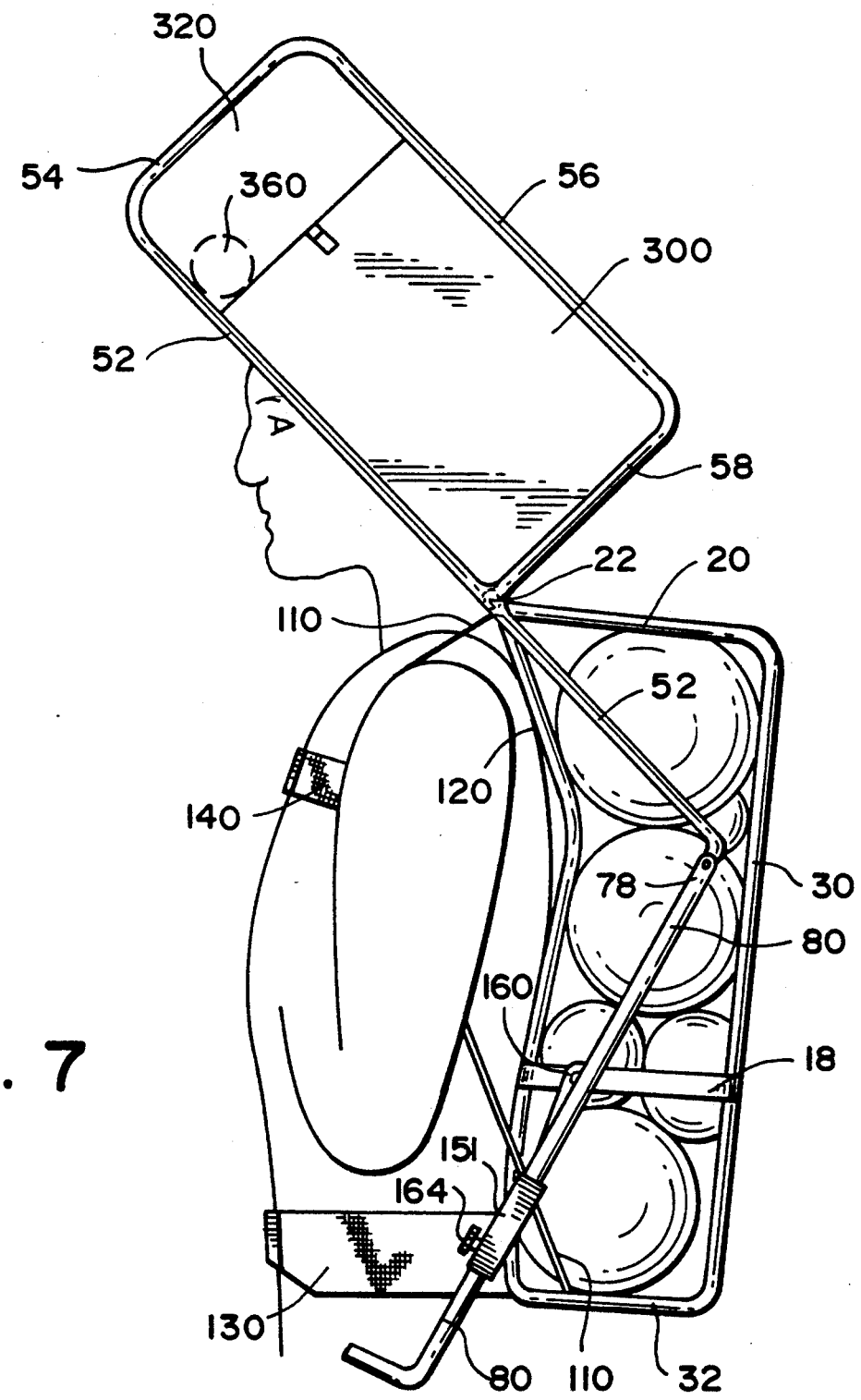
FIG. 7 is a right side view of the adjustable backpack frame according to the present invention fitted to a bearer and showing the upper frame in a forward rotated position for balance over the bearer's shoulders and also showing typical loads that may be carried by the frame.

As shown in FIGS. 1, 6 and 7, upper frame 50 is intended to be positioned above the lower frame 10 and is pivoted to the lower frame by pivot means 22, 22' to permit the upper frame to be rotated forward when the bearer exerts a backward or pushing force on arm 80. A forward or pulling force on arm 80 causes the upper frame to pivot clockwise and be positioned above the lower frame 10. The forward position of the upper frame 50 is best illustrated in FIGS. 4 and 7. The backward position of the upper frame 50 is best illustrated in FIGS. 2 and 3.

Upper frame 50 is preferably formed from a plurality of tubular members to provide a centrally open rectangular carrying frame with a central, forward clearance area for the bearer's head when the upper frame 50 is pivoted forward. Frame 50 includes forward vertical frame members 52, 52', connected via a pair of upper frame members 54, 54' and a pair of lower frame members 58, 58' to back corner frame members 56, 56'. Members 52, 52'; 54, 54'; 56, 56'; and 58, 58' form an open rectangle at opposite sides of the upper frame through which articles to be carried may be loaded into the upper frame. The left and right side sections are joined together at the back by an upper frame cross piece 66 and a lower cross piece 72. An upper inwardly disposed reinforcing cross piece 64 and lower reinforcing cross pieces 70, 75 connect the left and right side frame sections. Vertical stiffening members 65, 67 are connected between the upper cross piece 66 and lower cross piece 72 to provide additional strength and rigidity to the frame. A central, forward open area 69 for the head of the bearer is provided between arm members 68, 68' connected between spaced inward locations on cross piece 64 and the forward arms 52, 52'. As can be best seen in FIG. 1, each arm member 68, 68' comprises three sections, an uppermost section **68*a* that extends forwardly from cross piece 64, a vertical section 68*b* that extends from the uppermost section and a lowermost section 68*c* that extends outwardly at a right angle in the plane of the vertical sections 68*b*, 68*b'* to join the arms 52, 52' at a point slightly above the plane in which cross tubes 58, 58' and cross pieces 70, 74 lie. If desired, a length of fabric material such as a mesh or a light canvas may be fastened between the central section of cross piece 64 and the central section of cross piece 70 to form a back head stop and separate the open head area 69 from the storage area of the frame. Other areas of the framework may also have fabric attached thereto to form separate storage compartments 300, 310, 320 and 330, as shown in FIG. 6, and the entire framework may have affixed thereto a suitable canvas or other material 71 as shown in FIG. 6 which enclosed and protects the equipment and materials carried within the frame. In any event, the overall dimension of the upper frame 50 is such that there is sufficient room to place containers in compartment areas above the head 320, as well as behind the head 330, as shown in FIGS. 6 and 7**.

Placing heavy items, such as water, in the upper area 320 helps in providing counterbalance action with a minimum of rotation of upper frame 50. If water is placed in this upper area, flexible tubing 350 can be connected between a water bottle 360 disposed in this area and operatively connected through the upper body hollow tubing, such as members 64, 68, and 52 (see also FIG. 1), exiting through a protective outlet grommet 340 through which tubing 350 is extended. With simple manipulation, the flexible tubing 350 can be placed in the frame-bearer's mouth. A clamp 352 disposed at the end of the tubing is adapted to be finger-operated so that the bearer can have access to and drink from the water bottle 360 located in the balanced upper frame pack, without the inconvenience of unfastening the frame, removing the water bottle, drinking from it and thereafter repacking the bottle. For convenience, a conventional clamp 354 is mounted on the stiffener 68 to receive tubing 350 when not in use.

Referring to FIG. 1, the lower frame 10 is attached to the frame bearer in a manner similar to attachment of frames well known in the prior art. A pair of adjustable shoulder straps 110 and 110' are connected to the top of the lower frame on member 38 and to the bottom of the lower frame to members 32 and 32', respectively. A mesh back-support 120, partially shown in FIG. 1, is stretched across the upper part of the area between members 16 and 16'. An adjustable belt 130 is attached to members 12 and 12'. Referring to FIG. 6, the shoulder straps are placed over the shoulders and under the arms of the frame bearer and adjusted to force the mesh back-support 120 to rest against the frame bearer's upper back. The belt 130 is adjusted to fit around the frame bearer's waist to connect the frame to the frame bearer's hip section in a manner similar to well-know prior art frame connections to a frame bearer. An optional chest belt 140 may also be used to fasten the frame on the body. The upper frame may then be pivoted forward to distribute the weight closer over a line passing through the hips and legs of the bearer.

Figure 5:
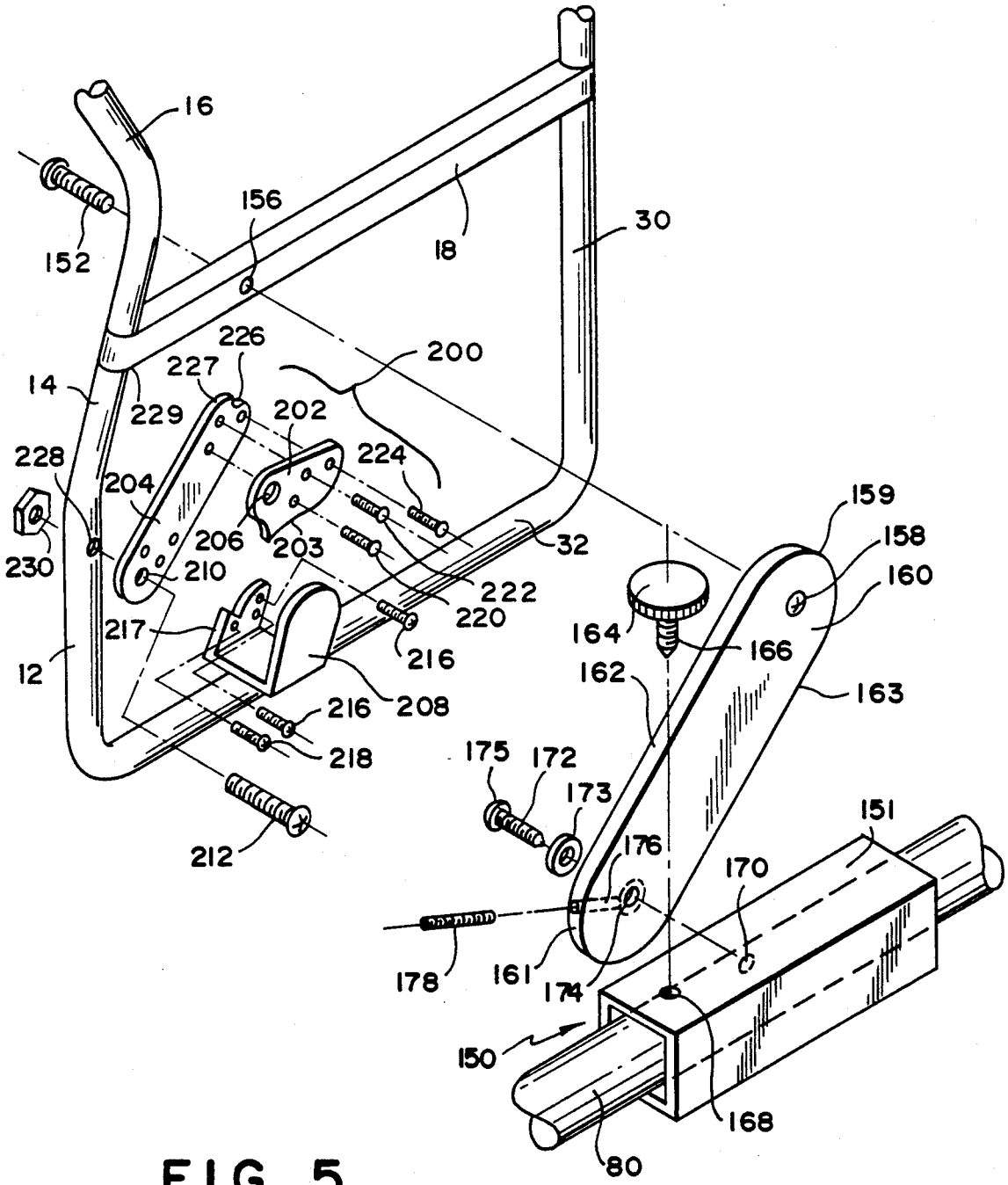
FIG. 5 is a fragmentary view in perspective of a slide and restraining mechanism in accordance with the present invention which enables the upper frame to be rotated about its pivot and locked in a selected position.

The mechanism 150 for effecting the pivotal action of the upper frame and lower frame is shown in detail in FIG. 5. The method for controlling rotation of upper frame 50 may be manual or automatic and the description herein will be limited to the manual operation. An automatic method for rotating the upper frame 50 need only incorporate a sensor to determine the best balance position of the upper frame and a small sensor responsive motor and spring loaded drive mechanism for positioning arm 80.

Referring now to FIGS. 1 and 5, it can be seen that the forwardmost end of arm 80 passes through slide mechanism 150 comprising a cylindrical or rectangular tube slide 151. Arm 80 is adapted to be locked in place by a screw 164 having a threaded shaft which is threadingly engaged in aperture 168. To rotate the upper frame 50 about its pivot, screw 164 is unscrewed slightly so that arm 80 is free to move.

Slide member 151 is connected to cross piece 18 by means of a rotatable link 160. Link 160 is pinned for rotation to the lower frame by means of pin 152 which is passed through aperture 156 and cross piece 18 and through an aperture 158 adjacent the upper end 159 of link 160. A second aperture 174 adjacent the other end of link of 160 receives pivot pin 172 which has one end disposed in aperture 170 and which passes through aperture 174 which provide a bearing surface for pin 172. A washer 173 may be positioned adjacent head 175 to ensure free rotation of link 160. Bore 176 extends from the periphery of link 160 to aperture 174 and receives a locking screw 178 which locks the link 160 to the pivot pin 172.

Link 160 provides a convenient arrangement for ensuring that the arm 80 can be conveniently stored out of harm's way and so that it does not interfere with the bearer during mounting of the frame to the bearer. To this end, reference should be made to FIGS. 2 and 3. Looking at FIG. 3 first, it will be seen that arm 80 is in its outermost extended position. Swinging arm 80 upward and clockwise causes it to pivot about pin 78 until it reaches the position shown in FIG. 2 where it nests snugly against frame member 52. The natural functional holding forces of the various parts are generally sufficient to keep arm 80 in place once raised to its uppermost position; however, if desired, a convenient spring clip (not shown) may be included on arm 52 or a suitable restraining tie 153 (shown in FIG. 3) may be connected at the end of arm 80 to allow arm 80 to be fastened in place.

In order to restrain link 160 from pivoting freely during positioning of the upper frame, restraining means 200, best shown in FIG. 5, is mounted to the lower frame piece 12. Restraining means 200 comprises three major parts, a guide 202, a supporting strap 204 and a saddle or seat 208. Supporting strap 204 is pivotally fastened at one end through aperture 210 to piece 12 through aperture 228 by pin 212 which is threaded at one end to receive holding nut 230. The other end of strap 204 includes a notch 226 which provides a raised surface 227 adapted to engage the edge 229 of strap 18 to hold strap 204 in place, as shown in FIG. 2 and FIG. 5.

Guide 202 is fastened to the upper part of strap 204 by threaded bolts 220, 222, 224 and includes an angle surface 203. Seat 208 is fastened to lower part or end of strap 204 by two or more threaded bolts 216, 218 passing through apertures in upward extending side member 217. The outward extending surface 219 of guide 204 forms with surface 203 a slot or channel which straddles opposite sides 162, 163 of pivot link 160. A raised abutment or side member 208 provides additional restraint against the side member 151 to prevent lateral motion thereof when positioning the upper frame. So long as strap 204 is in place in the position shown in FIGS. 2 and 3, and mechanism 150 is in place as shown in FIG. 3, arm 80 is held in its operative position to allow the upper frame to be positioned by exertion of an appropriate pushing or pulling force along the axis of arm 80. When strap 204 is rotated counterclockwise about pivot pin 212, slide mechanism 151 is freed from any restraint and arm 80 can be pivoted upward and out of way as shown in FIG. 2.

It should be evident that to position or set upper frame 50, screw 164 is first loosened to free arm 80 and then a backward force is applied along the axis of arm 80. This causes arm 80 to slide in mechanism 150 exerting a force against the lower end of arm 52 which pivots about pivot 78 causing the upper frame to rotate counterclockwise. When a desired position is reached, screw 164 is tightened to lock arm 80 in place.

Figure 8:
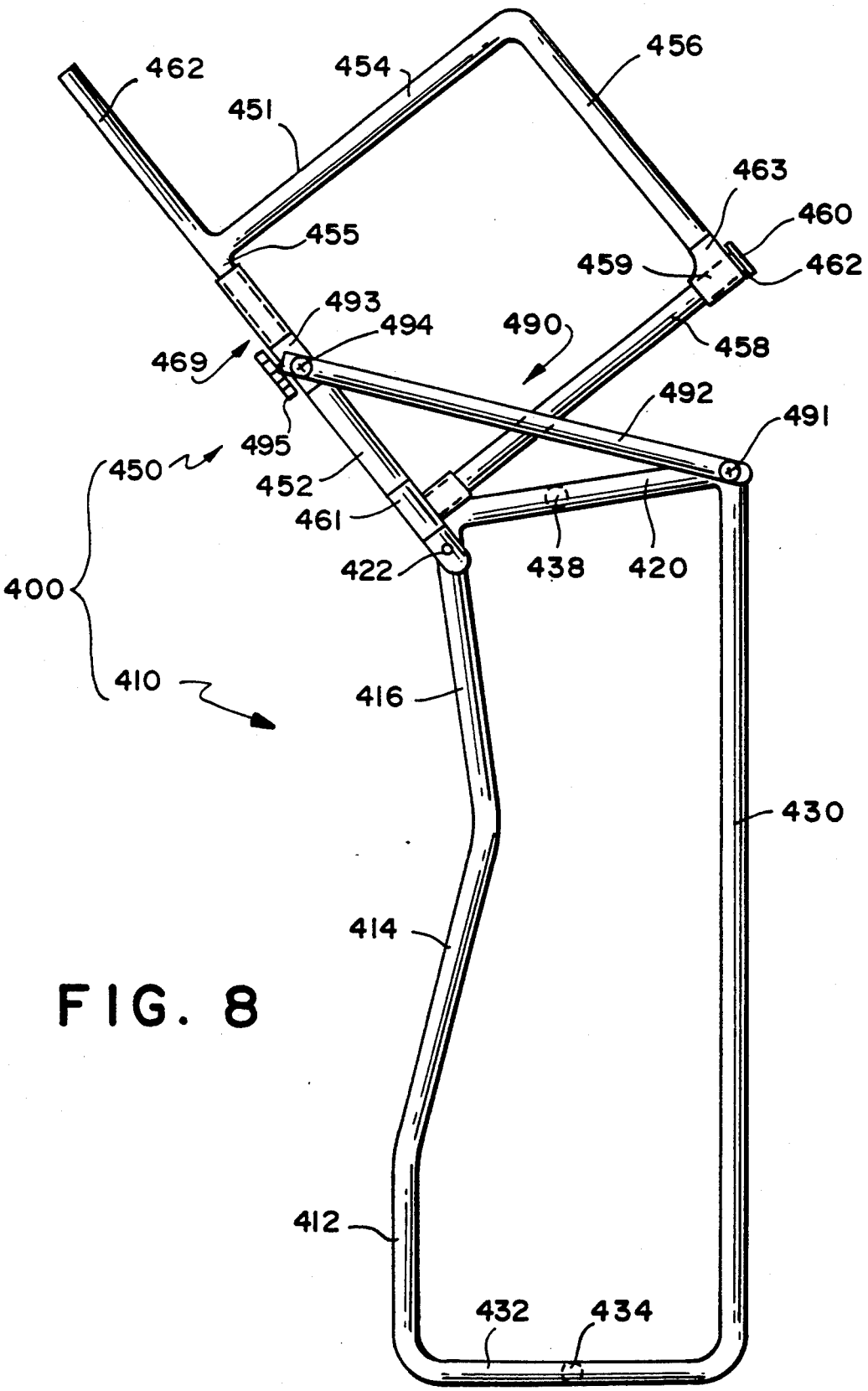
FIG. 8 is a right side view of an alternate embodiment of the present invention with the pivot connection for the upper frame positioned at the upper rearward part of the lower frame and showing the upper frame in a forward pivoted position.

A simplified version of the counter-balanced backpack frame, useful when a minimum of complexity is desired, is shown in FIG. 8. Referring to FIG. 8, the backpack unit 400 comprises a lower frame 410 and an upper frame 450, with parts 412 through 458 having the same functions as corresponding parts of the lower frame 10 and upper frame 50 of the previous figures. However, the control mechanism of FIG. 8 has been simplified by deleting the folding operating arm 80, the associated slide mechanism 150 and restraining means 200 and replacing it with a control mechanism 490 comprising elements 491 through 495 of FIG. 8. A slide member 493 is disposed on tubular member 452. Arm 492 is pivotally connected at one end on a first pivot pin 491 and the back upper part of the lower frame and at its other end to a second pivot pin 494 on slide 493. As the upper frame 450 rotates around pivot 422, slide 493 is adapted to slide upon member 452. At any particular rotation of the upper frame 450, a particular position of the slide 493 will be obtained. Tightening knob 495 on slide 493 fixes the slide on member 452 to restrain the upper frame from rotation. It should be noted that only the right side of the backpack frame is shown and the left side is a mirror image thereof with the slide mechanism duplicated.

To adjust the upper frame for balance when the frame is mounted to the frame-bearer, the frame bearer loosens the slide 493 by turning knob 495, and then rotates the upper frame until the desired balance is achieved. When the desired balance is achieved, knob 495 is tightened. If both left and right slides are provided, then, of course, both slides must be loosened before the frame can be selectively positioned.

The upper frame 450 includes an upper horizontal platform 451 comprising a plurality of cross members 454 and including a vertical forward extension formed by members 462. As in the case of the embodiment shown in FIG. 1, a head space 469 is provided to allow forward positioning of frame 450 over the hip line of the bearer. Platform 451 is particularly advantageous when it may be necessary to carry an irregular heavy load.

This embodiment of upper frame 450 is applicable to the control mechanism of FIG. 2, as well as FIG. 8, while the reverse is also true. Further, the arrangement of FIG. 8 can also be quickly broken down into its two main parts for ease of handling, transport and storage. To this end, frame 450 includes a left and right side tubular member 459 received in left and right side tubular members 458. A gripping member 460 allows the tubular members to be withdrawn through members 459 from T connection 461. Left and right side tubular members 455, which are extensions of left and right members 462, are likewise positioned within left and right side member 452. Thus, the top frame comprising members 462, 455, 454, 456 and 458 can be separated from the lower frame by withdrawing members 455 from members 452 which can then be moved out of the way. To this end, after removal of the back frame slide 493 may be moved up and free of member 452 allowing arm 452 to rotate around pin 422 downward and allowing arm 492 to rotate around pin 491 downward and out of the way.

From the foregoing description, one skilled in the art can easily ascertain the essential characteristics of the subject invention and, without departing from the spirit and scope thereof, can make various changes and modifications of the invention to adapt it to various usages and conditions.

I claim:

1. A backpack frame comprising an upper frame, a lower frame, means for supporting said upper frame for rotation on said lower frame about an axis parallel to a bearer's shoulders, control means for selectively positioning the upper frame relative to the lower frame, said control means comprising a slide mechanism on one of said upper and lower frames and arm means connected between the slide mechanism and the other of said upper and lower frames.

2. A backpack frame as set forth in claim 1 wherein said upper frame has an unobstructed forward section to provide clearance for a bearer's head when in use and when the upper frame is rotated in a forward direction to be positioned above a bearer's body.

3. A backpack frame as set forth in claim 1 wherein said arm means is a rigid arm pivotally connected to the lower and the upper frame.

4. A backpack frame as set forth in claim 1 further including restraining means connected to the lower frame for restraining lateral motion of said arm.

5. A backpack frame as set forth in claim 1 wherein said arm means includes an element disposed to pass through said slide mechanism and means for selectively locking said slide mechanism against further movement.

6. A backpack frame as set forth in claim 5 further including means for pivotally supporting said arm means to said lower frame for rotation upon rotation of the upper frame.

7. A backpack frame as set forth in claim 1 including water storage means disposed in said upper frame and means including flexible tubing extending from the water source to point near the bearer's mouth and clamp means connected to said tubing for controlling the flow of water through the tube.

8. A backpack frame as set forth in claim 1 wherein said means for supporting said upper frame for rotation comprises a pivot connection on the lower frame.

9. A backpack frame as set forth in claim 1 wherein said arm means is pivotally supported on said other of said upper and lower frames.

10. A backpack frame as set forth in claim 1, including means for selectively detaching said upper frame from said lower frame.

11. A backpack frame as set forth in claim 10, wherein said means for selectively detaching comprises a pair of tubular members forming part of the upper frame and adapted to be removably connected to a pair of tubular members forming part of the lower frame.

12. A backpack frame as set forth in claim 1 wherein said upper frame has an unobstructed forward section to provide clearance for a bearer's head when the backpack frame is in use.

13. A backpack frame adapted to be affixed to a bearer's body by a harness, comprising a waist belt, shoulder straps and back-support, the improvement comprising a first upper frame, a second lower frame, means for supporting said upper frame for rotation around said lower frame about an axis parallel to a bearer's shoulders and for selectively positioning the upper frame to counterbalance a load carried by the lower frame so that the center of gravity of the pack load comprising a load carried by the upper frame and the load carried by the lower frame is substantially over the hip line of the bearer and said means for selectively positioning said upper frame includes a slide mechanism on one of said upper and lower frames and arm means connected between the slide mechanism and the other of said upper and lower frames.

14. A backpack frame as set forth in claim 13, wherein said means for supporting the upper frame for rotation includes a pivot hinge on the lower frame and means connecting the upper frame to said pivot hinge.

15. A backpack frame as set forth in claim 13, said arm means including an arm member connected to the slide mechanism and to the lower frame for controlling rotation of the upper frame.

16. A backpack frame as set forth in claim 15, wherein said arm member is pivotally supported to said lower frame.

17. A backpack frame as set forth in claim 16, wherein the pivotal support for said arm member comprises a strip having a first end and a second end and pivotally connected at said first end to said lower frame and at said second end to said slide mechanism.

18. A backpack frame as set forth in claim 13 wherein said upper frame includes an unobstructed forward section to provide clearance for a bearer's head when the backpack frame is supported on the bearer for use.

19. A backpack frame as set forth in claim 13 wherein said slide mechanism includes means for locking the slide mechanism to the upper frame.

* * * * *